US010844293B2

(12) United States Patent
Cook

(10) Patent No.: US 10,844,293 B2
(45) Date of Patent: Nov. 24, 2020

(54) SPARKLESS IGNITERS FOR HEATER TREATERS AND METHODS FOR USING SAME

(71) Applicant: Surefire Pilotless Burner Systems LLC, Farmington, NM (US)

(72) Inventor: Ronnie Cook, Farmington, NM (US)

(73) Assignee: Surefire Pilotless Burner Systems LLC, Farmington, NM (US)

( * ) Notice: Subject to any disclaimer, the term of this patent is extended or adjusted under 35 U.S.C. 154(b) by 211 days.

(21) Appl. No.: 16/139,095

(22) Filed: Sep. 23, 2018

(65) Prior Publication Data

US 2019/0093023 A1 Mar. 28, 2019

Related U.S. Application Data

(60) Provisional application No. 62/562,732, filed on Sep. 25, 2017.

(51) Int. Cl.
*C10G 33/00* (2006.01)
*E21B 43/34* (2006.01)
(Continued)

(52) U.S. Cl.
CPC ..... *C10G 33/00* (2013.01); *C10G 31/06* (2013.01); *C10G 33/06* (2013.01); *E21B 43/34* (2013.01); *F23D 14/02* (2013.01); *F23D 14/48* (2013.01); *F23D 14/56* (2013.01); *F23D 14/58* (2013.01); *F23N 5/10* (2013.01); *F23N 5/102* (2013.01); *F23N 5/123* (2013.01); *F23N 5/20* (2013.01); *F23N 5/203* (2013.01); *F23Q 7/00* (2013.01);
(Continued)

(58) Field of Classification Search
CPC ... F23Q 7/06; F23Q 13/02; F23Q 7/00; E21B 43/34; F23D 14/02; F23D 14/48; F23D 14/56; F23D 14/58; F23D 2207/00; F23D 2208/10; F23D 2209/10; F23N 5/10; F23N 5/102; F23N 5/123; F23N 5/20; F23N 5/203; F23N 2225/16
USPC ..... 431/254, 263
See application file for complete search history.

(56) References Cited

U.S. PATENT DOCUMENTS 1,845,999 A * 2/1932 Breese, Jr. ..... F23D 5/04 236/68 R
2,300,386 A * 10/1942 Lehmann ..... F23Q 7/00 219/264

(Continued)

FOREIGN PATENT DOCUMENTS

JP 2000193242 A * 7/2000 ..... F23D 14/48
JP 2014070754 A * 4/2014 ..... F23C 7/002

OTHER PUBLICATIONS

"Specification for Vertical and Horizontal Emulsion Treaters," API Specification 12L, Oct. 2008.

*Primary Examiner* — Steven B McAllister
*Assistant Examiner* — Daniel E. Namay
(74) *Attorney, Agent, or Firm* — ipTekk, LLC; Anand S. Chellappa

(57) ABSTRACT

Sparkless igniters comprising a hot surface igniter assembly and a nozzle that produce a flame plume with diameter substantially similar to the diameter of the fire tube, and flame length less than the length of each leg of the U-shaped fire tube in heater treaters are applicable to both vertical and horizontal heater treaters and improve the durability of fire tubes while reducing igniter fuel consumption by at least 30%.

26 Claims, 7 Drawing Sheets

Figure 1:
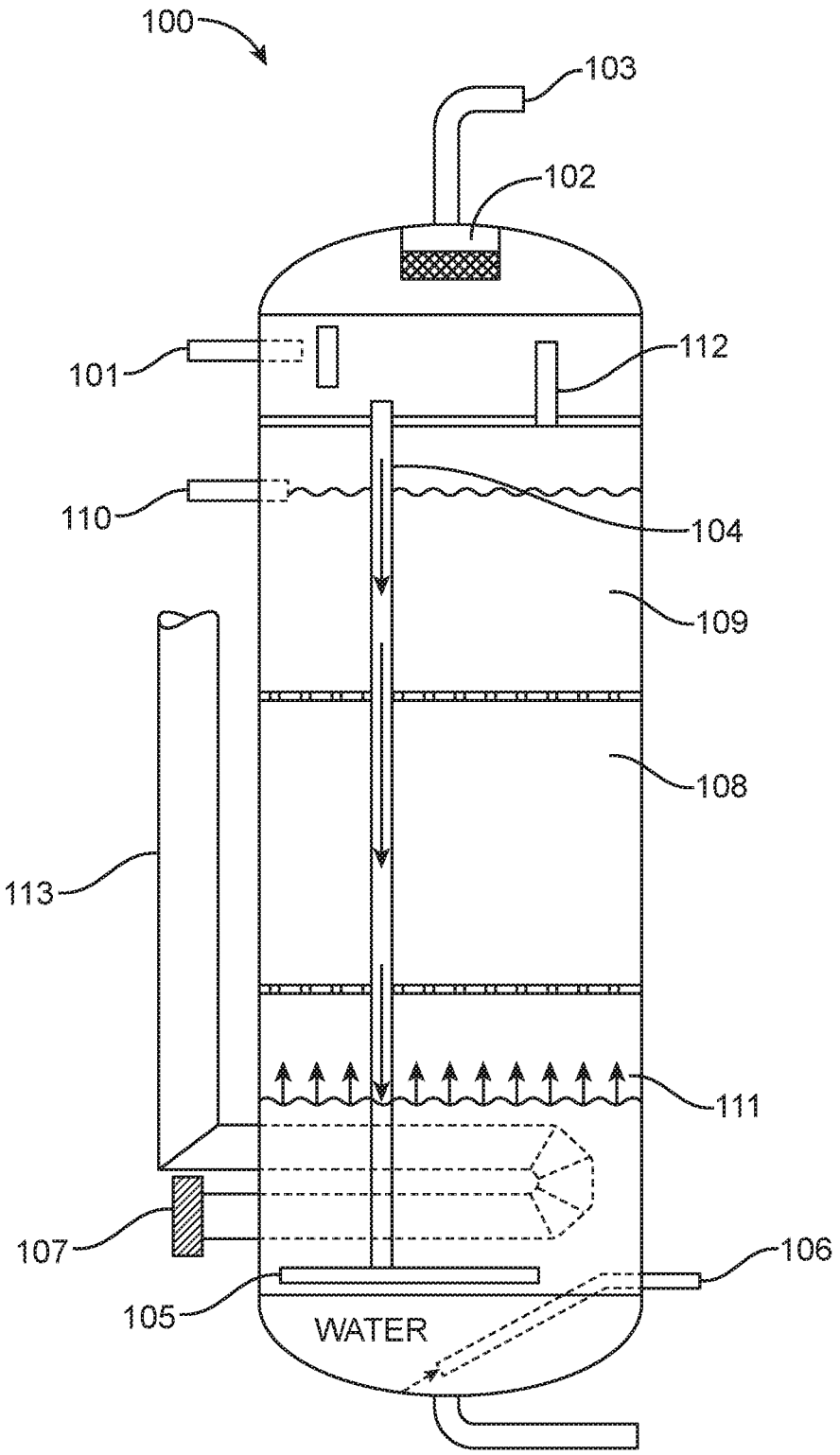

(51) Int. Cl.

| | |
|---|---|
| ***F23Q 7/00*** | (2006.01) |
| ***F23D 14/02*** | (2006.01) |
| ***F23D 14/58*** | (2006.01) |
| ***F23N 5/10*** | (2006.01) |
| ***F23N 5/20*** | (2006.01) |
| ***F23D 14/56*** | (2006.01) |
| ***F23N 5/12*** | (2006.01) |
| ***C10G 33/06*** | (2006.01) |
| ***C10G 31/06*** | (2006.01) |
| ***F23D 14/48*** | (2006.01) |
| ***F23Q 7/06*** | (2006.01) |

(52) U.S. Cl.

CPC ..... *F23Q 7/06* (2013.01); *C10G 2300/1033* (2013.01); *C10G 2300/208* (2013.01); *F23D 2207/00* (2013.01); *F23D 2208/10* (2013.01); *F23D 2209/10* (2013.01); *F23N 2225/16* (2020.01)

(56) References Cited

U.S. PATENT DOCUMENTS 2,777,512 A * 1/1957 Johnson ..... F23Q 13/00 431/263
3,339,617 A * 9/1967 Saha ..... F23D 14/00 431/263
3,364,968 A * 1/1968 Mutchler ..... F24H 9/1881 431/238
4,573,911 A 3/1986 Kimmich
4,702,692 A 10/1987 Burns et al.
5,599,371 A * 2/1997 Cain ..... C03B 19/1423 65/17.4
6,139,481 A * 10/2000 Norwood ..... B29C 65/106 431/353
6,664,514 B1 * 12/2003 Marshall ..... F23Q 7/22 219/267
9,593,847 B1 * 3/2017 Zink ..... F23D 14/60
2004/0018462 A1 * 1/2004 Stephens ..... F23C 9/00 431/115
2006/0172238 A1 8/2006 Cook
2015/0047361 A1 * 2/2015 Williams ..... F23D 3/22 60/746
2015/0152761 A1 * 6/2015 Tsumagari ..... F23D 11/443 60/303
2015/0292376 A1 * 10/2015 Tsumagari ..... F23D 91/02 422/187
2016/0281979 A1 * 9/2016 Fernandes ..... F23R 3/14
2017/0284669 A1 10/2017 Cook

* cited by examiner

SPARKLESS IGNITERS FOR HEATER TREATERS AND METHODS FOR USING SAME

CROSS REFERENCE TO RELATED APPLICATIONS

This application is related to and claims the benefit of and priority to U.S. Provisional Patent Application No. 62/562,732, filed Sep. 25, 2017, and entitled "Sparkless Igniters And Methods For Heater Treaters," the entire disclosure of which is hereby incorporated herein by reference in its entirety.

FIELD

The present invention relates, in general, to the field of combustion systems, and in particular, to sparkless igniters and methods for use in heater treaters.

BACKGROUND

Crude oil is often extracted from oil wells as an oil-water emulsion that may also contain significant amounts of free water and natural gas. Gas is separated from the oil-water emulsion and free water using a gas separator. Free water may be removed using water knock-out vessels, which are also known as phase separators. The resulting oil-water emulsion, with minimal amounts of gas and free water, is then sent to a treater (also referred to as heater treater) to separate water from the emulsion. The treater dehydrates or dewaters the produced crude oil to a required basic sediment and water (BS&W) level. Oil-water separation may be enhanced by heating, adding emulsion breaking chemicals, coalescing media, and/or electrostatic fields. Most crude oils are treated to a range of 0.2% to 3.0% BS&W as determined by the ASTM Standard Test No. D96-82. Treaters typically contain water knock-out and de-gassing zones to produce crude oil of desired quality. Heating lowers the viscosity of the oil making it easier for the water to settle. It also aids in the coalescing of the water droplets, which facilitates water removal. Heater treaters are used where the emulsion cannot be broken using just retention, quiescence, and chemical demulsifiers.

Heater treaters may be vertical or horizontal in design and installation. Horizontal heater treaters have a significantly larger oil treating section, provide for longer residence times, and are used to treat heavier crudes where significant settling (residence) time is required. A schematic diagram of an exemplary vertical heater treater 100 is shown in FIG. 1. Oil-water emulsion along with any associated gas and free water enters the vessel through inlet 101. Gas associated with the emulsion passes through a mist extractor 102 and is vented through gas exit 103. Mist extractors may be used on the outlet gas connection when the gas separation zone is operated at high loading or surging conditions. The emulsion along with any free water flows down to the bottom of the vessel through a down-corner 104 and may be distributed using spreader 105. Any free water settles down and is drained through water exit 106. The oil-water emulsion rises over fire tube 107 and is heated as it rises inside the heater treater. The water column at the bottom of the vessel also gets heated and serves to wash the emulsion and helps in coalescing the water droplets in coalescing section 108. The emulsion and oil continue to rise into the oil treating section 109 where the emulsion breaking process continues. Treated oil leaves the vessel at exit 110. For efficient emulsion breaking, it is generally recommended that the oil viscosity within the coalescing section of the treater should not exceed 150 Saybolt universal seconds (SSU). Emulsion heating may also be required to eliminate wax or bitumen as particulate matter that would tend to accumulate at the oil/water interface 111. The required treating temperature is typically between 100° F. and 250° F. Proprietary baffle and plate configurations may be employed to enhance oil/water separation. Residence time in the oil settling zone (regions 108 and 109) may be in the range of 30 to 100 minutes. Residence time in the water settling zone that sits below the oil settling zone is typically in the range of 15 to 30 minutes. Chemical injection into the feed emulsion may be used to further enhance coalescing performance to meet specified BS&W levels. Any gas flashed from the oil due to heating, flows through the equalizing line 112 to the gas space above, and is removed through exit 103. The oil level may be maintained by pneumatic or lever operated dump valves. The oil water interface may be controlled by an interface controller, or an adjustable external water leg.

Heating may be accomplished using one or more firetubes 107. Fire tube 107 may be of a U-shaped design. The heat load of the burner (firetubes) is normally calculated on the assumption that the water content of the emulsion being heated will not exceed 20%. A heating shroud around the firetube may be used to minimize the heat load transferred to free water that can settle without heating. A maximum firetube heat flux is typically 10,000 BTU/h/ft$^2$. Using a heat exchanger to recover heat from the treated crude that exits through tube 110 to heat incoming emulsion would reduce the amount of fuel required to heat the firetubes.

Ignition of fuel in the firetubes is done using a suitable fuel igniter that is removably affixed to fire tube 107. The igniter is typically fed with natural gas. Combustion product gases (flue gases) are vented through stack 113. Natural gas is a byproduct formed during oil extraction from oil wells, and is typically referred to as wellhead gas. Wellhead gas comprises a mixture of methane, ethane, propane, nitrogen, carbon dioxide, and water. Efficient operation of the treater depends on efficient firetube performance, which in turn depends on efficient igniter performance and adequate firetube design. Igniter performance depends on many factors including igniter design, durability of ignition elements, and proper adjustment of fuel gas pressure, which in turn controls fuel and air flow rates to the igniter. Firetube design depends on matching heat flux with the properties of the oil (water content etc.), selecting an optimum operating temperature and materials that provide good heat transfer without sacrificing durability. Commercially available igniters significantly reduce the durability of the firetube to less than five years in a vertical treater because the flame exiting the igniter through an igniter nozzle impinges on the bend region (U-shaped region) in the firetube, creates localized hotspots, and results in premature failure and significant replacement costs. Each leg of the U-shaped firetube is typically only about 4 feet in length before the bend. The diameter of the firetube is typically about 12 inch to about 20 inch. The flame plume obtained using these commercially available burner nozzles is approximately 5 inch to 7 inch in diameter and about 4 ft. to 6 ft. in length. The flame plume therefore impinges on the bend regions of the firetube and decreases durability of the firetube. In addition, the flame does not provide uniform heating along the length of the firetube (because the plume diameter is smaller than that of the fire tube), leading to higher fuel consumption and inefficient operation of the treater.

Ignition may be accomplished with spark igniters or sparkless igniters. In the case of spark ignition, the sparking tips require periodic cleaning to remove carbon accumulation formed as a byproduct of combustion. Further, periodic adjustment is required to maintain the spark gap between the two electrodes in a spark igniter. Therefore, there is an increasing interest in using sparkless ignition in treater firetubes.

Efficient sparkless igniters and methods to operate these igniters in conjunction with a suitable burner management system is therefore desired to improve the efficiency and reduce down time of heater treaters, and in particular, of vertical treaters.

BRIEF DISCLOSURE

In one aspect, a sparkless igniter comprises a fuel-air mixture inlet, a nozzle in fluid communication with the fuel-air mixture inlet and a fuel-air mixture conduit and disposed downstream of the fuel-air mixture inlet. The nozzle comprises a neck region and a throat region disposed contiguous with the neck region and separated by a boundary, a plurality of apertures characterized by a first diameter and arranged substantially in a first row in the neck region and disposed proximate to the boundary, a plurality of apertures characterized by a second diameter and arranged substantially in a second row in the throat region and disposed proximate to the boundary (the second diameter is less than the first diameter), and a plurality of apertures characterized by a third diameter and arranged substantially in a third row in the throat region and disposed between the second row and an exit end of the nozzle (the third diameter is less than the second diameter). A hot surface igniter assembly is removably disposed in the igniter such that a portion of the hot surface igniter assembly protrudes into the fuel-air mixture conduit to ignite the fuel-air mixture when the assembly is energized, and produces flue gases and a flame that exits through the plurality of apertures in at least one of the first, second, third rows of the nozzle and a nozzle orifice disposed at the exit end of the nozzle. The igniter may further comprise a flame sensor. In one embodiment, the flame sensor is a flame rod. In another embodiment, the flame sensor is a thermocouple.

In another aspect, a burner system for use in a vertical treater comprises an exemplary sparkless igniter removably affixed in the fire tube of the vertical treater, and a fuel-air mixer configured to deliver fuel-air mixture through an orifice in the mixer to the fuel-air mixture inlet of the igniter and through a nipple removably disposed between the mixer and the igniter. The length of the nipple is at least eight times the diameter of the nipple.

In another aspect, a method for heating the fire tube in a heater treater comprises providing an exemplary sparkless igniter removably affixed in the fire tube of the vertical treater to ignite a fuel-air mixture, and providing a fuel-air mixer configured to deliver fuel-air mixture through an orifice in the mixer to the fuel-air mixture inlet of the igniter and through a nipple removably disposed between the mixer and the igniter. The length of the nipple is at least eight times the diameter of the nipple. Ignition of the fuel-air mixture generates a flame plume having a diameter substantially equal to the diameter of the fire tube and a flame length less than the length of each leg of the fire tube. The heater treater may be a vertical heater treater or a horizontal heater treater.

In another aspect, a method for heating the fire tube in a heater treater comprises providing an exemplary sparkless igniter comprising a flame rod and removably affixed in the fire tube of the heater treater, energizing the hot surface igniter assembly for a first time period, providing a fuel-air mixture to the igniter, measuring a control parameter such as a flame strength value (FSV) of the igniter wherein the energizing of the hot surface igniter assembly is continued for a second time period if the FSV is greater than a threshold FSV, shutting off fuel-air mixture to the igniter if the FSV is greater than the threshold FSV after the second time period and waiting for a third time period, and repeating the ignition sequence until the FSV falls below the threshold FSV that indicates successful ignition of the fuel-air mixture in the fire tube.

In another aspect, a method for heating the fire tube in a heater treater comprises providing an exemplary sparkless igniter comprising a thermocouple and removably affixed in the fire tube of the heater treater, energizing the hot surface igniter assembly for between about 8 seconds and about 10 seconds, providing a fuel-air mixture to the igniter, monitoring the change in temperature ($\Delta T$) relative to ambient temperature after about 30 seconds, shutting off fuel-air mixture to the igniter if $\Delta T$ is less than about 100° C. and waiting for about 2 minutes, repeating the ignition sequence until $\Delta T$ is greater than about 100° C., monitoring the flame temperature at about 10 second intervals until a maximum flame temperature is reached and shutting off fuel-air mixture if the flame temperature decreases by about 1% of the maximum temperature.

In another aspect, a nozzle for use in a sparkless igniter comprises a neck region and a throat region disposed contiguous with the neck region and separated by a boundary, a first plurality of apertures disposed in the neck region upstream of the boundary, a second plurality of apertures disposed in the throat region between the boundary and an exit end of the nozzle, and a nozzle orifice disposed at the exit end of the nozzle wherein the cross sectional area of the first plurality of apertures is between about 40% and about 45% of the total cross sectional area of the first plurality of apertures, second plurality of apertures and the nozzle orifice. Ignition of a fuel-air mixture in the sparkless igniter results in flue gases and a flame exiting through at least one of the plurality of apertures and the nozzle orifice.

Other features and advantages of the present disclosure will be set forth, in part, in the descriptions which follow and the accompanying drawings, wherein the preferred aspects of the present disclosure are described and shown, and in part, will become apparent to those skilled in the art upon examination of the following detailed description taken in conjunction with the accompanying drawings or may be learned by practice of the present disclosure. The advantages of the present disclosure may be realized and attained by means of the instrumentalities and combinations particularly pointed out in the appendant claims.

DRAWINGS

The foregoing aspects and many of the attendant advantages of this disclosure will become more readily appreciated as the same becomes better understood by reference to the following detailed description, when taken in conjunction with the accompanying drawings, wherein:

FIG. 1. Schematic diagram of a vertical heater treater.

Figure 2A:
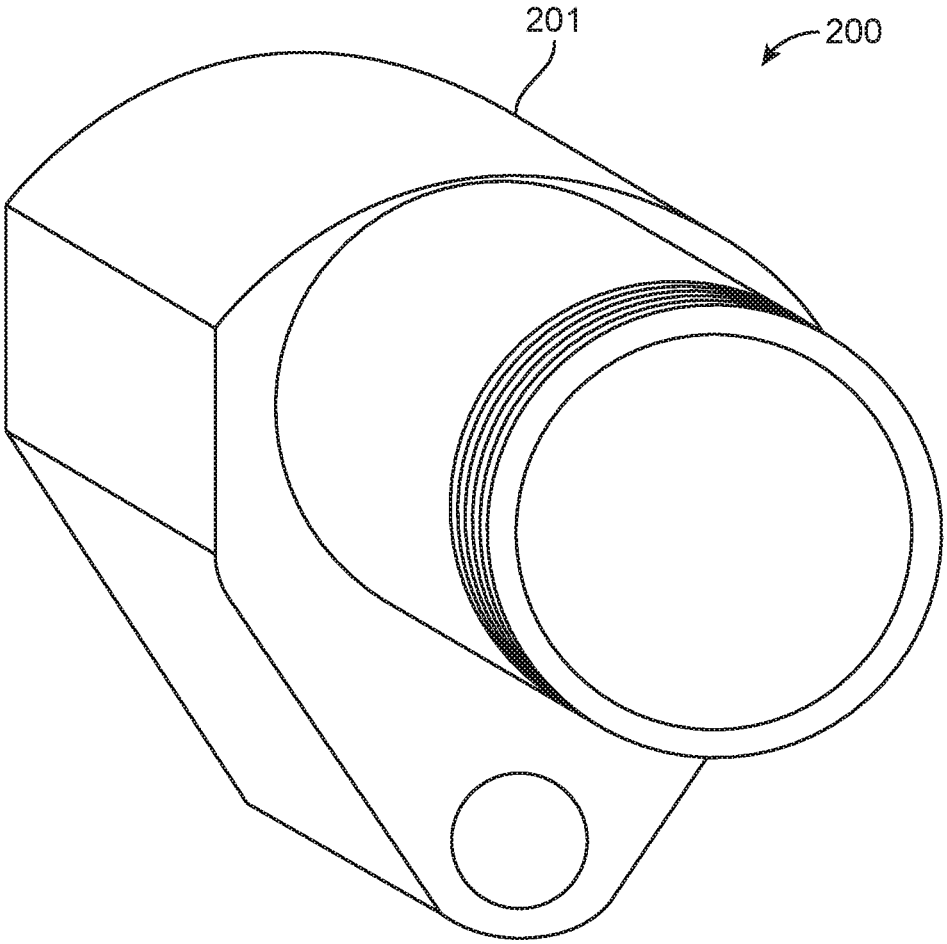

FIG. 2A. Perspective drawing of an exemplary sparkless igniter body.

Figure 2B:
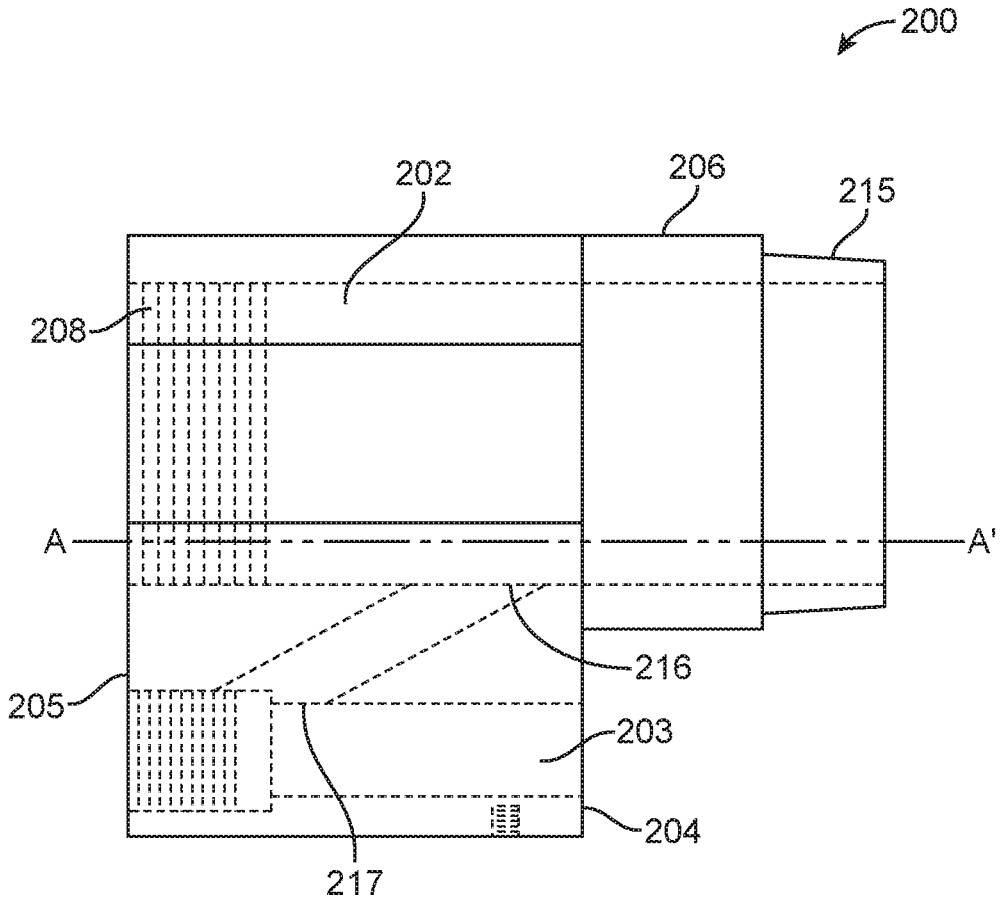

FIG. 2B. Side view of an exemplary sparkless igniter body.

Figure 2C:
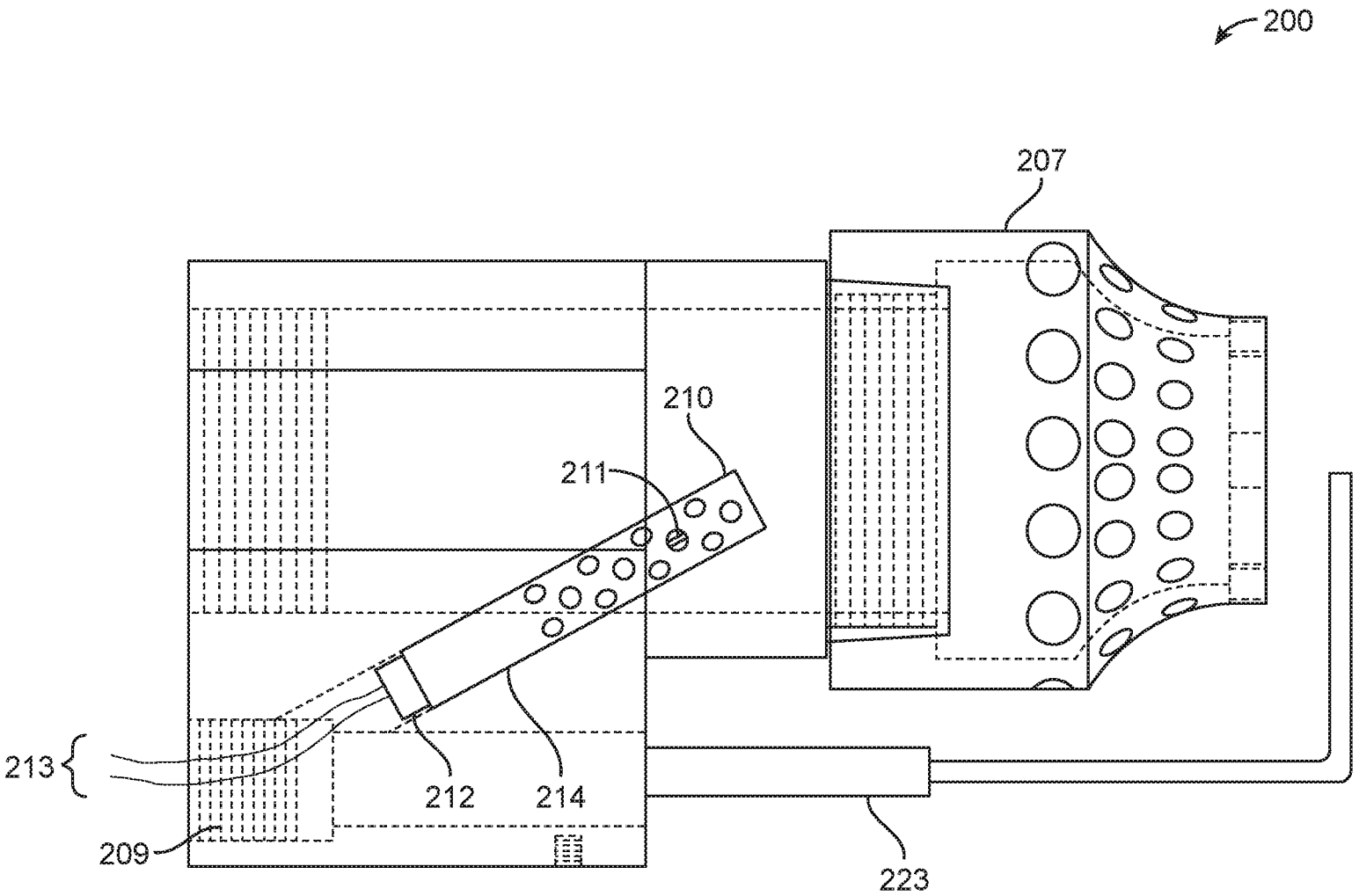

FIG. 2C. Side view of an exemplary igniter with nozzle showing the location of the hot surface igniter assembly inside it.

Figure 2D:
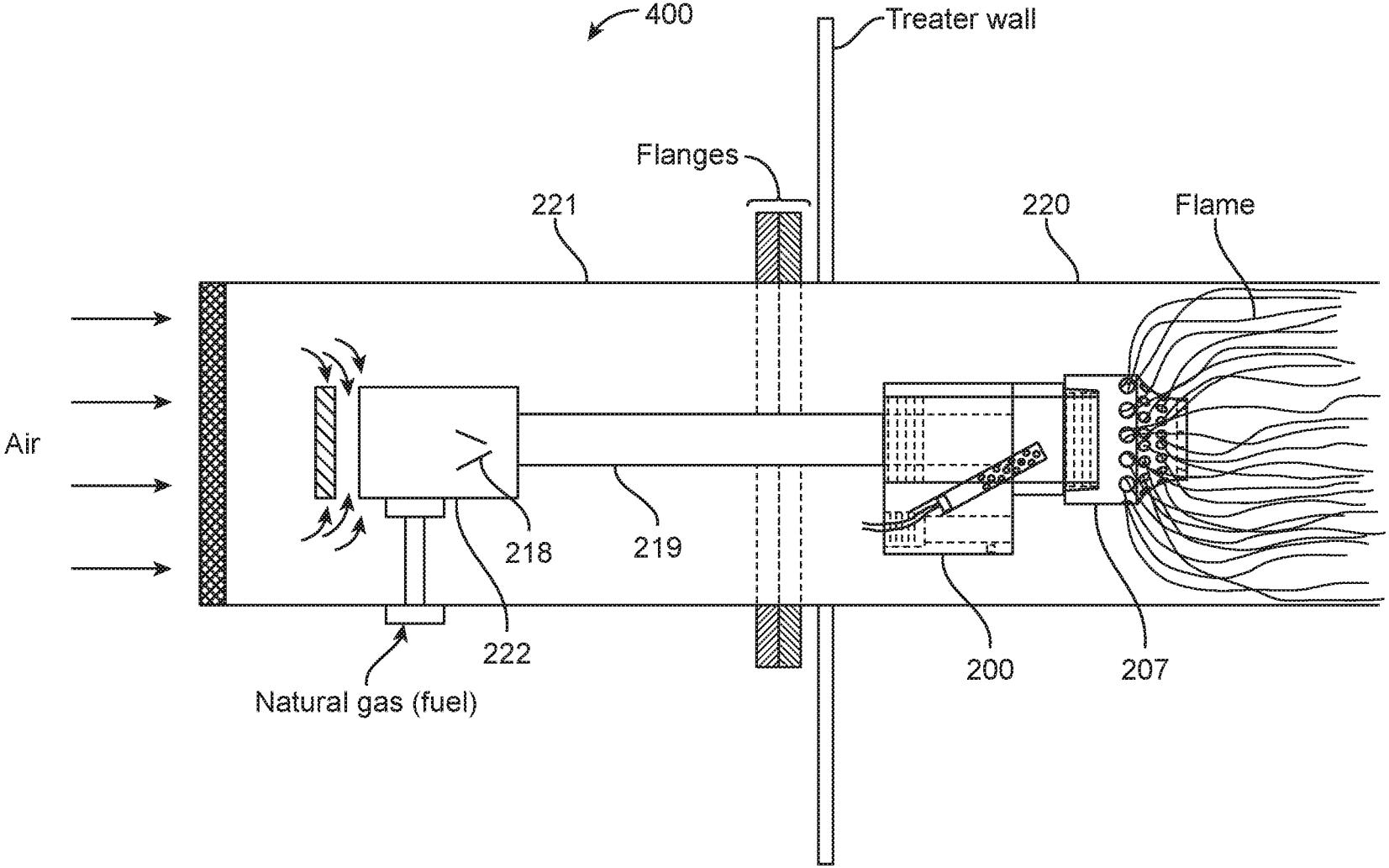

FIG. 2D. Schematic diagram of an exemplary burner system for a heater treater showing an exemplary igniter inside a fire tube.

Figure 3A:
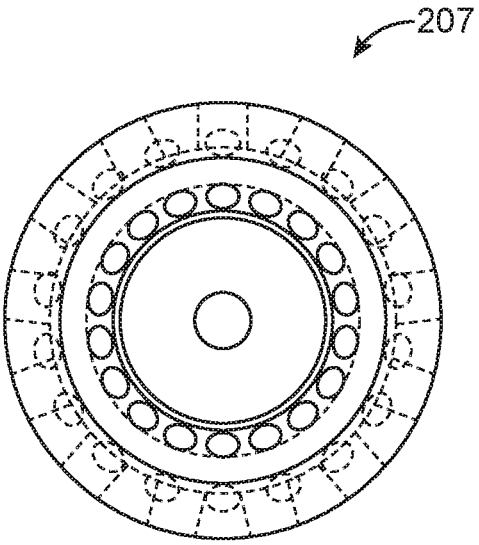
Figure 3B:
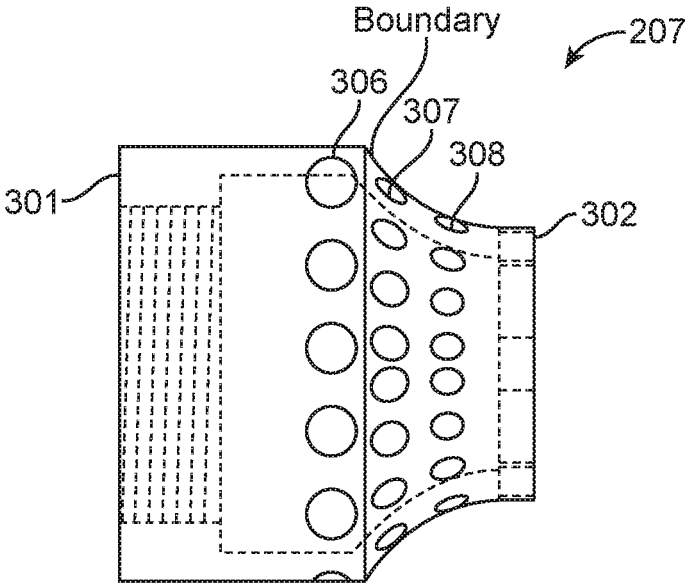
Figure 3C:
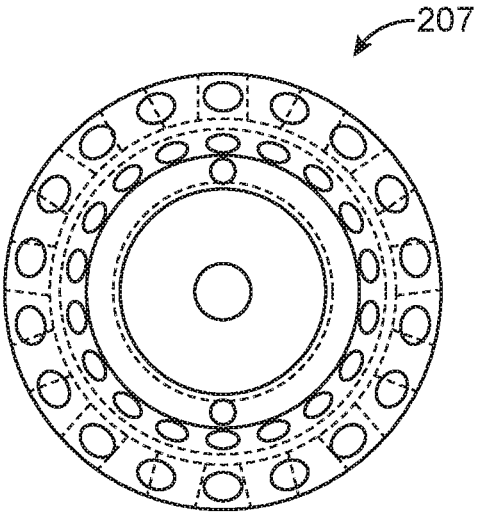

FIGS. 3A, 3B, and 3C depict a bottom view, a side view, and a top view of an exemplary igniter nozzle, respectively.

Figure 3D:
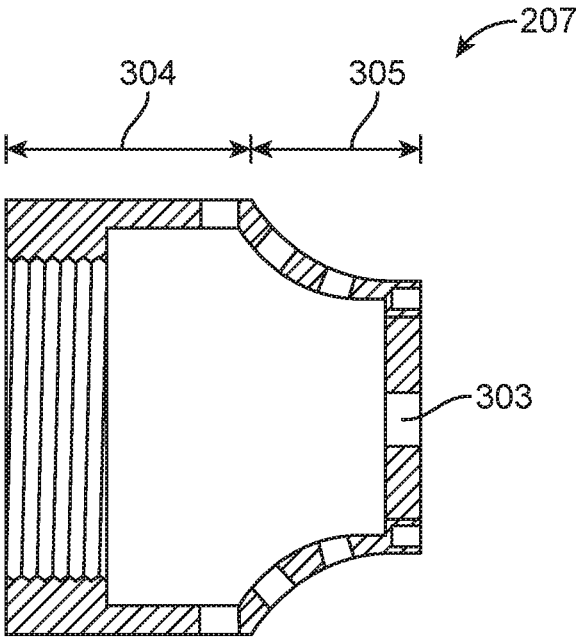

FIG. 3D. Cross-sectional side view of an exemplary igniter nozzle.

Figure 4A:
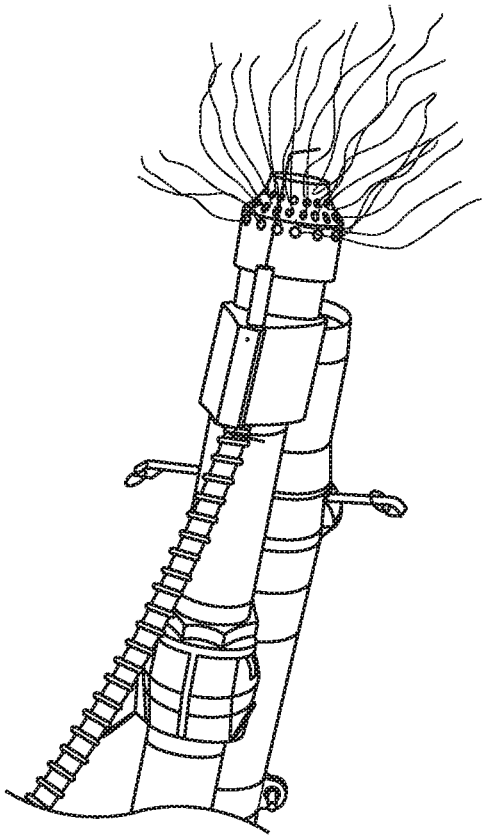
Figure 4B:
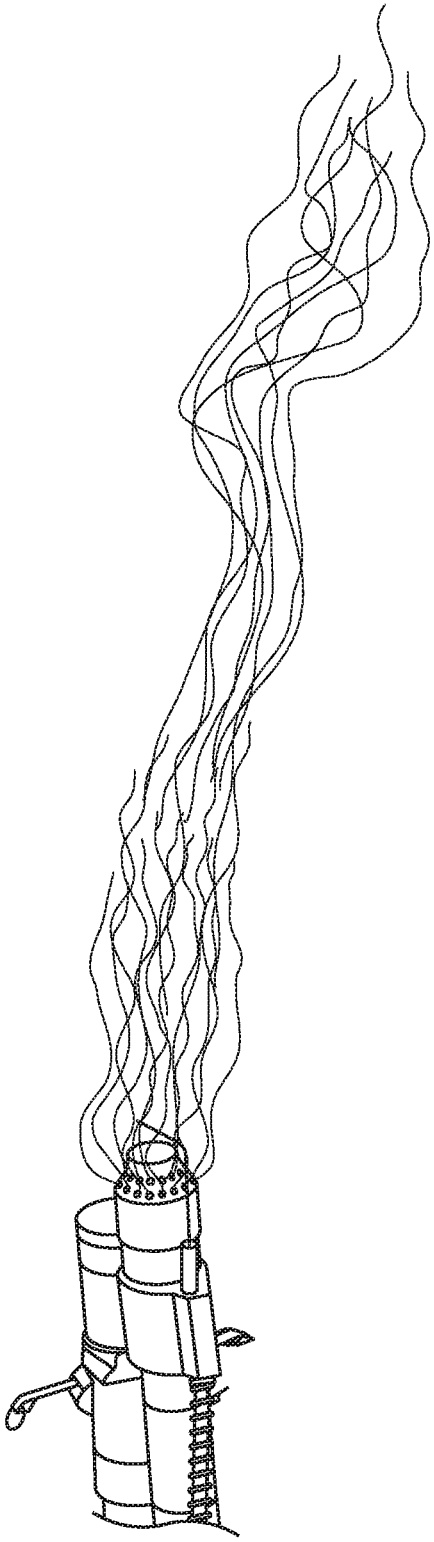

FIGS. 4A and 4B show flame plume patterns obtained using an exemplary nozzle and using a commercially available nozzle, respectively.

All reference numerals, designators and callouts in the figures are hereby incorporated by this reference as if fully set forth herein. The failure to number an element in a figure is not intended to waive any rights. Unnumbered references may also be identified by alpha characters in the figures and appendices.

The following detailed description includes references to the accompanying drawings, which form a part of the detailed description. The drawings show, by way of illustration, specific embodiments in which igniter designs for heater treaters may be practiced. These embodiments, which are also referred to herein as "examples" or "options," are described in enough detail to enable those skilled in the art to practice the present invention. The embodiments may be combined, other embodiments may be utilized or structural or logical changes may be made without departing from the scope of the invention. The following detailed description is, therefore, not to be taken in a limiting sense and the scope of the invention is defined by the appended claims and their legal equivalents.

In this document, the terms "a" or "an" are used to include one or more than one, and the term "or" is used to refer to a nonexclusive "or" unless otherwise indicated. Further, "igniter," and "ignitor," should be construed to have the same meaning. "Fire tube" and "firetube" should be construed to have the same meaning. In addition, it is to be understood that the phraseology or terminology employed herein, and not otherwise defined, is for the purpose of description only and not of limitation. An emulsion is a relatively stable dispersion of water and oil which exits from flowing or pumped oil wells. For construing the scope of the term "about," the error bounds associated with the values (dimensions, operating conditions etc.) disclosed is ±10% of the values indicated in this disclosure. The error bounds associated with the values disclosed as percentages is ±10% of the percentages indicated.

DETAILED DISCLOSURE

Particular aspects of the invention are described below in considerable detail for the purpose for illustrating its principles and operation. However, various modifications may be made, and the scope of the invention is not limited to the exemplary aspects described.

FIGS. 2A, 2B, and 2C illustrate various features of an exemplary sparkless igniter 200. The igniter body 201 is preferably made of aluminum alloy such as the 6061 aluminum alloy. The 6061 alloy is a precipitation hardened aluminum alloy, contains magnesium and silicon as its primary alloying elements, and can withstand temperatures of at least 1000° F. Body 201 comprises a first internal conduit, namely, a fuel-air mixture conduit 202, and a second internal conduit, namely, an electrical conduit 203. Conduits 202 and 203 are each disposed on either side of the longitudinal axis AA' of body 201, run substantially parallel to each other, and may run from the front end 204 to the back end 205 of body 201. At the front end 204, a portion of body 201 is configured to be in the form of a hollow neck 206 that is in fluid communication with the fuel-air mixture conduit 202. The free end of neck 206 may be threaded 215 to removably couple with an igniter nozzle 207 (FIG. 3). The nozzle may be made of materials such as carbon steel and stainless steel 304, is normally rated to above 2500° F., and designed to produce a well-developed steady flame of a desired flame shape. The hollow neck 206 fluidly communicates with the fuel-air mixture conduit 202 to a threaded opening 208 located at the back end 205. Wellhead gas or fuel is pre-mixed with air prior to feeding to igniter 200 through a nipple that removably connects to threaded opening 208. FIG. 2D illustrates how the exemplary igniter 200 is connected to burner system 400 of a vertical treater. Fuel and air is pre-mixed preferably in mixer 222 (2 in.×2 in., for example, supplied by Eclipse, Inc.) and flows through an orifice 218 in the mixer that is sized to yield the required air/fuel ratio. With the exemplary igniter 200, the diameter of the orifice is between about 0.10 inch and about 0.15, and preferably about 0.125 inch, for a fuel feed pressure of about 8 psig to 10 psig. The fuel/air mixture then flows through nipple 219, that is in fluid communication with fuel-air mixture conduit 202 of igniter 200 that is disposed in firetube 220. The diameter of nipple 219 is between about 1.5 inch and about 2.5 inch, and preferably about 2 inch. The length of nipple 219 is preferably at least eight times its diameter. With a feed pressure of about 8 psig to 10 psig and an orifice diameter of about 0.125 inch, the length of nipple 219 is preferably between about 16 inch to about 20 inch to prevent flashback of the flame from firetube 220 to the flame arrester section 221. In the firetube 220, nipple 219 may be optionally supported using support elements (e.g. Unistruts), which are not shown in FIG. 2D.

Exemplary nozzle 207 may be rated to support vertical treater firetube rating of about 500,000 BTU/h. Operating with about 4 vol.-% residual oxygen in the flue gas exiting the vertical treater at a flue stack temperature of about 900° F., and using natural gas with a heating value (HHV) of 1050 BTU/SCF as the fuel, yields a combustion efficiency of about 69% (API Specification 12L). The heating value of natural gas may however vary between 1000 and 1600 BTU/SCF. Under these exemplary conditions, igniter 200 comprising nozzle 207 may ignite about 700 SCF (standard cubic feet) of natural gas. Nozzle 207 comprises a fuel entry end 301 and an exit end 302 (FIG. 3). End 301 may be configured to be screwed on to threaded section 215 of neck 206 of the igniter 200. When nozzle 207 is used to heat the firetube in typical vertical heater treaters, end 301 may be characterized by an outer diameter of about 3 inch, and end 302 by an outer diameter of about 1.4 inch. Combustion flue gases and flames exit the nozzle, in part, through nozzle orifice 303 having a diameter between about 0.35 inch and 0.4 inch, and preferably about 0.375 inch. The size of the nozzle orifice 303 at the exit end of the nozzle is preferably between about 0.3 inch and about 0.4 inch in diameter. Between ends 301 and 302, nozzle 207 comprises a neck region 304 that is contiguous with a throat region 305. The length of the neck region may be about 1.7 inch and that of the throat region about 1.17 inch when nozzle 207 is used to heat the firetube in typical vertical heater treaters. The combustion hot (flue) gases and flame exit nozzle orifice 303 and heat fire tube 220 of the vertical treater. Combustion flue gases and flame also exit through a plurality of apertures located in the neck region and throat region of nozzle 207.

In an exemplary nozzle 207, a first row of apertures 306 may comprise a plurality of apertures of diameter between about 0.3 inch and 0.35 inch, and preferably about 0.344 inch and pitch (distance between the centers of consecutive apertures in the first row) of about 0.574 inch, and are disposed in the neck region proximate to the boundary between the neck region 304 and throat region 305. Additionally, the throat region may comprise a second row of apertures 307 comprising a plurality of apertures of diameter between about 0.23 inch and 0.28 inch, and preferably about 0.25 inch, and located proximate to the boundary between neck and throat regions. The throat region may also comprise a third row of apertures 308 comprising a plurality of apertures of diameter between about 0.18 inch and about 0.22 inch, and preferably about 0.22 inch and located between the second row of apertures and the end 302. The cross sectional area of the first row of apertures is between about 40% and about 45% of the total cross sectional area provided by the apertures in the first, second, third rows and by the nozzle orifice. The cross-sectional area of the second row apertures is between about 28% and about 35% of the total area, that of third row apertures is between about 20% and about 25% of the total area, and that of the nozzle orifice is between about 3% and about 6% of the total area. The exemplary nozzle yields a flame plume that is about 12 inch to 20 inch in diameter and about 2 ft. in length inside firetube 220 having a nominal diameter of about 12 inch to about 20 inch. The flame plume therefore does not impinge upon the bend regions of the firetube as each leg of the fire tube is about 4 ft. in length. In addition, the flame provides uniform heat distribution along the length of the firetube leading to more efficient treater operation.

In a commercially available nozzle sold by the applicant, the neck region does not comprise of any apertures. Instead, the throat region comprised a first row of a plurality of apertures of diameter of about 0.25 inch and located proximate to the boundary between neck and throat regions. The throat region also comprised a second row of a plurality of apertures of diameter of about 0.22 inch and located between the second row of apertures and the exit end of the nozzle. Further the diameter of the nozzle orifice located in the exit end was about 1.42 inch. FIG. 4. shows flame plume patterns obtained during combustion of natural gas in both the exemplary nozzle and the commercially available nozzle. As can be seen, the flame from the exemplary nozzle despite having a smaller orifice 303 compared to a commercial nozzle has a "bushy" shape and shorter flame length which makes it suitable for use in heater treaters, and in particular, vertical heater treaters. In contrast, the flame obtained with the commercial nozzle is significantly longer with a pencil type flame and would impinge upon the U-region of the firetubes in vertical heaters causing local hot spots and failure of the fire tubes. As previously discussed, the exemplary nozzle while incorporated in a burner system as shown in FIG. 2D, directs the flame to the sides of the fire tube, eliminates the occurrence of hot spots, and evenly distributes heats along the length of the fire tube. As a result, heat transfer efficiency to the emulsion increases, thereby reducing igniter fuel consumption by about 30% to about 35%, and reduces fuel costs. In addition to improving the durability of firetubes in heater treaters, exemplary igniter 200 permits the fuel feed pressure to be reduced from 12-14 psig (commercial nozzle) to about 8-10 psig. This pressure reduction subsequently reduces the fuel flow rate to mixer 222, permits the use of orifice 218 of diameter between about 0.10 inch and 0.15 inch, and preferably about 0.125 inch, and increases the air/fuel ratio in the fuel-air mixture that flows to igniter 200. Higher air/fuel ratios reduce unburnt hydrocarbons in the igniter exhaust gas and also reduces soot formation.

Alternately, igniter nozzle 207 may be suitably modified to directly couple to the igniter body 200 that does not contain the neck 206. For example, one end of nozzle 207 could be configured to comprise a male threaded section that can be screwed into a mating female threaded section in body 201 that is fluid communication with the fuel-air mixture conduit 202. Further, the nozzle may be removably attached to the conduit 202 using flanges or other quick connect fittings.

A cylindrical hot surface ignition assembly (HSI) 210 is removably inserted through opening 217 in conduit 203 (FIG. 2B), and through a corresponding opening 216 in conduit 202, and extends into neck region 206 as shown in FIG. 2C at an angle of about 28° to about 30° relative to the central axis of conduit 203. Ignition wiring 213 of HSI assembly 210 is routed out the back end of igniter 200 through threaded opening 209. The wiring is preferably electrically connected to a ⅜" electrical flexible fitting, which is removably screwed (0.5 inch NPT) into the threaded portion 209 of electrical conduit 203. The wiring is then routed to a burner management system. Openings 216 and 217 may be sealed using suitable sealant materials. The ignition wiring 213 connected to the HSI element is rated to withstand at least 1000° F.

The HSI assembly is configured to fit snugly in the opening that connects conduits 202 and 203. HSI assembly 210 comprises an igniter heating element 211 that is substantially enclosed in a high temperature ceramic body 212. Wires 213 are electrically connected to the igniter heating element 211 and are used to energize the igniter heating element using preferably a DC (direct current) electrical source. A portion of element 211 protrudes from the ceramic body 212. A high temperature alloy guard (e.g. Inconel guard) 214 protects the ceramic body, and the exposed part of heating element 211. The diameter of the Inconel guard is preferably 0.4 inch to 0.5 inch in diameter, and more preferably 0.4 inch to 0.45 inch. HSI assembly (not including the length of the wires 213) is preferably 2 inch to 3 inch in length and more preferably between 2 inch and 2.5 inch in length. The length of the heating element 211 that protrudes from the ceramic body 212 is preferably between 0.3 inch and 0.6 inch and more preferably between 0.4 inch and 0.55 inch.

The igniter element may be made of durable, high temperature materials such as silicon carbide or silicon nitride. Other transition metal carbides or nitrides may also be used. When a suitable voltage (preferably DC voltage) is applied to the element 211, it heats up to enable auto ignition of the fuel or wellhead gas flowing in conduit 202. The HSI element is heated for a predetermined time before it is exposed to the fuel-air mixture. The predetermined time for energizing the HSI may be in the order of a few seconds, and preferably between 5 seconds and 15 seconds. If ignition is not detected within the predetermined time, the gas valve closes and the burner management system will repeat the start-up sequence. HSI assemblies are available from sources that include, but are not limited to, Robertshaw, Crystal Technica, Honeywell, and the like. These igniters may be energized using 12 to 24 VDC or 120 to 280 VAC. The heating elements may be enclosed proprietary ceramic composite materials.

Igniter 200 is equipped with a flame sensor 223, which senses the presence or absence of a flame, and feeds the signal to a burner management system. Flame sensors include, but are not limited to, flame rods and thermocouples. At start-up, the HSI element is energized before fuel feed is started. Fuel pressure is controlled to about 5-15 psig using a suitable regulator. Auto-ignition of the fuel-air mixture on the hot surface of the HSI element is detected using the flame sensor. If a flame is not detected within the predetermined time, the fuel valve close and the system recycles. If a flame is extinguished for any reason during operation, the fuel valve closes and the system recycles.

In the case of a flame rod, an AC current is applied to the flame rod such as Kanthal flame rods rated to 2600° F. (available for example, from Honeywell), which then flows through the ions in the flame, and to the igniter assembly/head to ground. Because the surface area of the flame rod is much smaller than that of the igniter head, the AC current is rectified to DC current in the process commonly known as flame rectification. The magnitude of this current could vary from 0.25 to 8 mA. Armored wiring harness rated at 500° F. or above is used. The burner management system opens the main gas valve to the igniter if it detects a DC current (which may be converted to a suitable voltage reading using resistors) of pre-determined magnitude. As an alternative to flame rods, thermocouples may be used to sense the temperature of the flame and/or exhaust gases. An exemplary thermocouple is the K-type thermocouple, which is rated to 2400° F. Because these thermocouples are located in the flame, they are usually sheathed in high temperature metal sheaths such as Inconel.

Other variations in nozzle design may be used to achieve similar results. In fact, nozzles that provide for different flame length and flame diameter may be interchangeably used with the exemplary igniter. For example, one or more rows of apertures of varying diameters may be used depending on at least one of desired fuel flow rate, fire tube design, and heat duty of the fire tubes. Apertures need not be circular in shape. Other shapes such as oval shaped apertures may be used. Any single row may comprise a plurality of apertures of varying diameters. The nozzle may comprise a plurality of neck and throat regions. Further, apertures of varying diameters may be located in the neck and throat regions with their centers offset from one another instead of being arranged in rows. That is, the apertures need not be arranged in rows. While exemplary nozzles have been demonstrated in vertical heater treaters, they may be also used in horizontal treaters. The disclosed sparkless igniter can be scaled up or scaled down in size depending on the heat duty that is desired for the particular application.

Exemplary nozzle 207 that comprise a plurality of apertures arranged in rows or in other patterns, may also comprise elements such as shutters to selectively open and close one or more aperture rows to obtain the desired flame plume shape to optimize heat transfer efficiency and durability of firetubes of various dimensions. This feature eliminates the need to replace nozzle 207 in igniters whenever the dimensions of the firetube and heat duty changes. Shutter type elements may also be used to change the size of the nozzle orifice 303. The exemplary nozzle may be used in spark igniters wherein the HSI element is replaced with a sparking mechanism.

Igniter operation may be controller using a burner management system (BMS). During start-up, the HSI element in exemplary igniter 200 is energized for about 8 seconds to 10 seconds, preferably using a DC voltage of about 12 to about 24 volts. The HSI element temperature rapidly increases to auto-ignition temperature of the fuel. The burner management system then initiates fuel flow to the igniter and monitors the signal from the flame sensor. When the igniter is equipped with a flame rod as the sensor 223, the BMS checks whether ignition has occurred by monitoring Flame Strength Value (FSV) of the igniter as a control parameter. An FSV of about 3 to about 4 (equivalent to 555 mV) indicates that ignition has occurred. An FSV of greater than about 250 (threshold value) indicates that ignition failed to occur, in which case, the igniter stays energized for an additional time period of about 5 seconds to about 10 seconds. Typically, in the absence of a flame, the FSV is about 504 to about 505 (equivalent to about 4700 mV). If ignition continues to fail, the BMS shuts off fuel flow, waits for 1-3 minutes, preferably about 2 minutes, and initiates the above sequence once again. A burner management system as disclosed in U.S. application Ser. No. 11/047,794 entitled "METHOD, APPARATUS AND SYSTEM FOR CONTROLLING A GAS-FIRED HEATER," may be used to control operation of the exemplary igniter. Instead of monitoring a calculated parameter such as FSV, the BMS may monitor the output of the flame rod in terms of current (mA) or voltage (mV). FSV is generally a function of electrical resistance of the HSI element and exhibits a linear relationship with measured electrical resistance.

If a thermocouple is used as the flame sensor (instead of a flame rod), during start-up, the HSI element in exemplary igniter 200 is energized for between about 8 seconds and about 10 seconds, preferably using a DC voltage of about 12 to about 24 volts. The HSI element temperature rapidly increases to auto-ignition temperature of the fuel. The burner management system initiates fuel flow to the igniter. After about 30 seconds, the BMS monitors the change in flame temperature ($\Delta T$) relative to ambient temperature. A $\Delta T$ value of about 100° C. in about 30 seconds ($^{\Delta T}/_{\Delta t}$ of about 3.3 degrees/second) indicates the presence of a flame. If ignition failed to occur, the fuel flow is shut off and the sequence is repeated again. If ignition was successful, the BMS monitors flame temperature at intervals of about 10 seconds until the temperature levels off at a maximum temperature (typically 600° F. to 2000° F. depending on the heating value of the fuel and the application). The BMS continues to monitor temperature at 10 second intervals. A decrease in temperature by at least 1% of maximum temperature indicates that the absence of a flame. The BMS shuts off fuel flow and the sequence is repeated again.

The BMS also measures the resistance of the HSI element. The measured resistance of the HSI element can also be used to predict if the HSI element or assembly is wearing out. Aging of the resistance wires may occur at high temperatures due to cyclic operation, and possibly due to some carbon formation. The resistance of the HSI element is also a function of the age of the HSI element. Aging generally causes an increase in the resistance of the HSI element. The resistance of a fresh HSI element is about 2 ohms, and more typically between 1.6 and 2.4 ohms at a reference temperature of 50° C. An aged igniter element is characterized by a resistance of about 3.5 ohms at a reference temperature of 50° C. An increase in measured resistance at a reference temperature would suggest that the heating element is aging. As a remedial measure, the energizing voltage to the HSI element can be increased in steps of about 0.5 volts (when DC voltage is used) to compensate for the aging of the heating element. Increasing the energizing voltage is warranted if the measured resistance at a reference temperature exceeds the baseline resistance by more than 50%, and preferably by more than 75% to compensate for ageing of the hot igniter surface assembly. If this action fails, replacement of the HSI element would be required. The control methods in the burner management system can also keep track of the service time of the HSI element, and increase resistance accordingly to offset the effects of aging to achieve a predetermined ignition temperature.

In another aspect, the igniter body may comprise of more than one subassemblies that are removably coupled to form the igniter body assembly. One or more of the subassemblies may be opened to replace or swap out worn out or malfunctioning hot surface elements if needed. This permits the user to use the same sparkles igniter, while changing out the HSI elements, when needed and could lead to cost savings.

The disclosed sparkless igniter requires no cleaning and adjustments once installed and commissioned in a burner management system. The use of the disclosed igniter in burner management systems is particularly beneficial when operating at remote sites (often at freezing conditions in winter) because traveling to these sites is difficult and often hazardous.

The Abstract is provided to comply with 37 C.F.R. § 1.72(b), to allow the reader to determine quickly from a cursory inspection the nature and gist of the technical disclosure. It should not be used to interpret or limit the scope or meaning of the claims.

Although the present disclosure has been described in connection with the preferred form of practicing it, those of ordinary skill in the art will understand that many modifications can be made thereto without departing from the spirit of the present disclosure. Accordingly, it is not intended that the scope of the disclosure in any way be limited by the above description.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects of the disclosure both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled. It should be understood that all actions may be expressed as a means for taking that action or as an element which causes that action. Similarly, each physical element disclosed should be understood to encompass a disclosure of the action which that physical element facilitates.

In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising," are intended to imply the inclusion of a stated element or step or group of elements or steps, but not the exclusion of any other element or step or group of elements or steps. Such terms should be interpreted in their most expansive forms so as to afford the applicant the broadest coverage legally permissible.

What is claimed is:

1. A sparkless igniter comprising:

a fuel-air mixture inlet;

a nozzle in fluid communication with the fuel-air mixture inlet and a fuel-air mixture conduit and disposed downstream of the fuel-air mixture inlet, wherein the nozzle comprises:

a neck region and a throat region disposed contiguous with the neck region and separated by a boundary;

a plurality of apertures characterized by a first diameter and arranged substantially in a first row in the neck region and disposed proximate to the boundary;

a plurality of apertures characterized by a second diameter and arranged substantially in a second row in the throat region and disposed proximate to the boundary wherein the second diameter is less than the first diameter;

a plurality of apertures characterized by a third diameter and arranged substantially in a third row in the throat region and disposed between the second row and an exit end of the nozzle, wherein the third diameter is less than the second diameter; and, a hot surface igniter assembly removably disposed in the igniter such that a portion of the hot surface igniter assembly protrudes into the fuel-air mixture conduit to ignite the fuel-air mixture when the assembly is energized to ignite a fuel-air mixture and produce flue gases and a flame that exits through the plurality of apertures in at least one of the first, second, third rows, and a nozzle orifice disposed at the exit end of the nozzle.

2. The igniter of claim 1 wherein the size of the apertures in the first row is preferably between about 0.3 inch and about 0.35 inch in diameter.

3. The igniter of claim 1 wherein the size of the apertures in the second row is preferably between about 0.23 inch and about 0.28 inch in diameter.

4. The igniter of claim 1 wherein the size of the apertures in the third row is preferably between about 0.18 inch and about 0.22 inch in diameter.

5. The igniter of claim 1 wherein the size of the nozzle orifice at the exit end of the nozzle is preferably between about 0.3 inch and about 0.4 inch in diameter.

6. The igniter of claim 1 wherein the nozzle is removably coupled to the igniter.

7. The igniter of claim 1 wherein the hot surface igniter assembly is cylindrical.

8. The igniter of claim 1 wherein the hot surface igniter assembly is energized using DC voltage.

9. The igniter of claim 8 wherein the DC voltage ranges from about 12 to about 24 volts.

10. The igniter of claim 1 wherein the portion of the hot surface igniter assembly that protrudes into the fuel-air mixture conduit substantially comprises an exposed hot surface igniter element surrounded by a protective shield.

11. The igniter of claim 1 further comprising a flame sensor.

12. The igniter of claim 11 wherein the flame sensor is a flame rod.

13. A method for heating the fire tube in a heater treater, the method comprising:

(a) providing an igniter according to claim 12 removably affixed in the fire tube of the heater treater;

(b) energizing the hot surface igniter assembly for a first time period;

(c) providing a fuel-air mixture to the igniter;

(d) measuring the flame strength value (FSV) of the igniter wherein the energizing of the hot surface igniter assembly is continued for a second time period if the FSV is greater than a threshold FSV;

(e) shutting off fuel-air mixture to the igniter if the FSV is greater than the threshold FSV after the second time period and waiting for a third time period; and, (f) repeating steps (b) to (d) until the FSV falls below the threshold FSV.

14. The method of claim 13 wherein the first time period is between about 8 seconds and about 10 seconds.

15. The method of claim 13 wherein the second time period is between about 5 seconds and about 10 seconds.

16. The method of claim 13 wherein the third time period is between about 1 minute and about 3 minutes.

17. The method of claim 13 wherein the threshold FSV is about 250.

18. The igniter of claim 11 wherein the flame sensor is a thermocouple.

19. A method for heating the fire tube in a heater treater, the method comprising:

(a) providing an igniter according to claim 18 removably affixed in the fire tube of the heater treater;

(b) energizing the hot surface igniter assembly for between about 8 seconds and about 10 seconds;

(c) providing a fuel-air mixture to the igniter;

(d) monitoring the change in temperature ($\Delta T$) relative to ambient temperature after about 30 seconds;

(e) shutting off fuel-air mixture to the igniter if $\Delta T$ is less than about 100° C. and waiting for about 2 minutes;

(f) repeating steps (b) to (e) until $\Delta T$ is greater than about 100° C.;

(g) monitoring the flame temperature at about 10 second intervals until a maximum flame temperature is reached; and, (h) shutting off fuel-air mixture if the flame temperature decreases by about 1% of the maximum temperature.

20. A burner system for use in a vertical treater comprising:

an igniter according to claim 1 removably affixed in the fire tube of the vertical treater; and, a fuel air mixer configured to deliver fuel-air mixture through an orifice in the mixer to the fuel-air mixture inlet of the igniter and through a nipple removably disposed between the mixer and the igniter, wherein the length of the nipple is at least eight times the diameter of the nipple.

21. The burner system of claim 20 wherein the diameter of the nipple is between about 1.5 inch and about 2.5 inch.

22. The burner system of claim 20 wherein the diameter of the orifice in the mixer is between about 0.10 inch and about 0.15 inch.

23. A method for heating the fire tube in a heater treater, the method comprising:

providing an igniter according to claim 1 removably affixed in the fire tube of the vertical treater to ignite a fuel-air mixture; and, providing a fuel-air mixer configured to deliver fuel-air mixture through an orifice in the mixer to the fuel-air mixture inlet of the igniter and through a nipple removably disposed between the mixer and the igniter, wherein the length of the nipple is at least eight times the diameter of the nipple, and wherein ignition of the fuel-air mixture generates a flame plume having a diameter substantially equal to the diameter of the fire tube and a flame length less than the length of each leg of the fire tube.

24. The method of claim 23 wherein the heater treater is a vertical heater treater.

25. The method of claim 23 wherein the heater treater is a horizontal heater treater.

26. A nozzle for use in a sparkless igniter comprising:

a neck region and a throat region disposed contiguous with the neck region and separated by a boundary;

a first plurality of apertures disposed in the neck region upstream of the boundary;

a second plurality of apertures disposed in the throat region between the boundary and an exit end of the nozzle; and, a nozzle orifice disposed at the exit end of the nozzle wherein the cross sectional area of the first plurality of apertures is between about 40% and about 45% of the total cross sectional area of the first plurality of apertures, second plurality of apertures and the nozzle orifice and wherein ignition of a fuel-air mixture in the sparkles igniter results in flue gases and a flame exiting through at least one of the plurality of apertures and the nozzle orifice.

* * * * *